US011381909B2

(12) United States Patent
Li et al.

(10) Patent No.: US 11,381,909 B2
(45) Date of Patent: Jul. 5, 2022

(54) METHOD AND APPARATUS FOR FORMING DIFFERENTIAL BEAM, METHOD AND APPARATUS FOR PROCESSING SIGNAL, AND CHIP

(71) Applicant: Shenzhen Goodix Technology Co., Ltd., Shenzhen (CN)

(72) Inventors: Na Li, Shenzhen (CN); Guoliang Li, Shenzhen (CN); Xinshan Wang, Shenzhen (CN); Hu Zhu, Shenzhen (CN); Hongjing Guo, Shenzhen (CN)

(73) Assignee: Shenzhen Goodix Technology Co., Ltd., Shenzhen (CN)

( * ) Notice: Subject to any disclaimer, the term of this patent is extended or adjusted under 35 U.S.C. 154(b) by 0 days.

(21) Appl. No.: 17/079,193

(22) Filed: Oct. 23, 2020

(65) Prior Publication Data

US 2021/0044897 A1 Feb. 11, 2021

Related U.S. Application Data

(63) Continuation of application No. PCT/CN2019/091307, filed on Jun. 14, 2019.

(51) Int. Cl.
*H04R 3/00* (2006.01)
*H04R 3/04* (2006.01)
(Continued)

(52) U.S. Cl.
CPC ..... *H04R 3/005* (2013.01); *H04R 3/04* (2013.01); *H04R 5/04* (2013.01); *H04S 1/00* (2013.01); *H04S 7/307* (2013.01)

(58) Field of Classification Search
None
See application file for complete search history.

(56) References Cited

U.S. PATENT DOCUMENTS

2009/0175466 A1 7/2009 Elko et al.
2010/0241428 A1 9/2010 Yiu
2011/0274289 A1* 11/2011 Tashev ..... H04B 7/0854 381/92

FOREIGN PATENT DOCUMENTS

CN 103295579 A 9/2013
CN 104854878 A 8/2015
CN 106653044 A 5/2017

OTHER PUBLICATIONS

Shenzhen Goodix Technology, Co., International Search Report, PCT/CN2019/091307, Sep. 3, 2020, 4 pgs.
(Continued)

*Primary Examiner* — James K Mooney
(74) *Attorney, Agent, or Firm* — USCH Law, PC

(57) ABSTRACT

Some embodiments of the present disclosure provide a method and an apparatus for forming a differential beam, a method and an apparatus for processing a signal, and a chip. The method for forming a differential beam includes: obtaining a differential beam forming signal according to an input signal acquired by two microphones in a microphone array (101); and performing a nonlinear adjustment on at least an amplitude of the differential beam forming signal based on a distance between the two microphones and a signal frequency of the input signal to obtain the adjusted differential beam forming signal (102). With the above solution, a constant beam characteristic of the differential beam forming signal can be ensured as much as possible for microphone arrays of different specifications.

18 Claims, 5 Drawing Sheets

(51) Int. Cl.

| | |
|---|---|
| ***H04R 5/04*** | (2006.01) |
| ***H04S 1/00*** | (2006.01) |
| ***H04S 7/00*** | (2006.01) |

(56) References Cited

OTHER PUBLICATIONS

Shenzhen Goodix Technology Co., Ltd., Extended European Search Report, EP19926741.0, dated Aug. 12, 2021, 7 pgs.
Henning Puder, "Acoustic Noise Control: An Overview of Several Methods Based on Applications in Hearing Aids," Communications, Computers and Signal Processing, 2009. PACRIM 2009. IEEE Pacific Rim Conference on, IEEE, Piscataway, NJ, USA, Aug. 23, 2009, 6 pgs.

* cited by examiner

METHOD AND APPARATUS FOR FORMING DIFFERENTIAL BEAM, METHOD AND APPARATUS FOR PROCESSING SIGNAL, AND CHIP

CROSS-REFERENCE TO RELATED APPLICATION

This application is a continuation of PCT Patent Application No. PCT/CN2019/091307, filed Jun. 14, 2019, which is hereby incorporated by reference in its entirety.

TECHNICAL FIELD

The present disclosure relates to signal processing technology, in particular to a method and an apparatus for forming a differential beam, a method and an apparatus for processing a signal, and a chip.

BACKGROUND

At present, in order to better meet call requirements, hands-free devices and head-mounted devices are generally set with a microphone array to enhance voice processing. The microphone array, formed by a set of microphones arranged in different positions in space in a certain way, may receive spatial signals, sample the spatially distributed field signals, and obtain the spatial discrete observation data of the signal source, and use the spatial information in the data for algorithm processing to enhance the desired voice and suppress useless interference and noise.

For a small omnidirectional dual microphone array, the signals of the two microphones may be processed through a difference algorithm to enhance the voice signal.

The inventor found that there are at least the following problems in existing technologies: the existing differential algorithm is only applicable to a case where a distance between the front and rear microphones in the microphone array is less than 2.5 cm. and may not guarantee a constant beam characteristics when the distance between the front and rear microphones is slightly greater than 2.5 cm.

SUMMARY

Some embodiments of the present disclosure provide a method and an apparatus for forming a differential beam, a method and an apparatus for processing a signal, and a chip, to ensure a constant beam characteristic of a differential beam forming signal of microphone arrays of different specifications as much as possible.

An embodiment of the present disclosure provides a method for forming a differential beam, including: obtaining a differential beam forming signal according to an input signal acquired by two microphones in a microphone array; and performing at least a nonlinear adjustment on an amplitude of the differential beam forming signal based on a distance between the two microphones and a signal frequency of the input signal to obtain an adjusted differential beam forming signal.

An embodiment of the present disclosure further provides a method for processing a signal, including: correcting a sound signal collected by the two microphones in the microphone array to obtain the input signal; performing a differential beam forming processing on the input signal based on the above-described method for forming a differential beam, and obtaining an adjusted differential beam forming signal; and post-filtering the adjusted differential beam forming signal.

An embodiment of the present disclosure further provides an apparatus for forming a differential beam, including: a forward differential filter and a backward differential filter, configured to receive an input signal acquired by two microphones in a microphone array; an adaptive filter connected to the backward differential filter; an adder connected to the forward differential filter and the adaptive filter respectively; wherein the input signal is processed by the forward differential filter, the backward differential filter and the adaptive filter to output by the adder to obtain a differential beam forming signal; and a compensation filter connected to the adder, configured to perform a nonlinear adjustment on at least an amplitude of the differential beam forming signal based on a distance between the two microphones and a signal frequency of the input signal to obtain an adjusted differential beam forming signal.

An embodiment of the present disclosure further provides an apparatus for processing signal, including: a corrector, configured to correct a sound signal collected by the two microphones in the microphone array to obtain the input signal; the above-described apparatus for forming a differential beam, configured to perform a differential beam forming processing on the input signal and obtain an adjusted differential beam forming signal; and a post-filter, configured to post-filter the adjusted differential beam forming signal.

An embodiment of the present disclosure further provides a chip, including the above-described apparatus for processing a signal.

An embodiment of the present disclosure further provides an electronic device, including a microphone array and the above-described chip. The microphone array includes at least two microphones, and the chip is connected to each microphone.

Compared with existing technologies, the input signal is acquired by the two microphones of the microphone array in the embodiment of the present disclosure, and then the differential beam forming signal is obtained according to the input signal acquired by the two microphones, and then at least the amplitude of the differential beam forming signal is nonlinearly adjusted based on the distance between the two microphones and the signal frequency of the input signals to obtain the adjusted differential beam forming signal. In other words, this embodiment provides an adjustment method to ensure the constant beam characteristic of the differential beam forming signal for microphone arrays of different specifications as much as possible after at least the amplitude of the differential beam forming signal is nonlinearly adjusted based on the distance between the two microphones and the signal frequency of the input signal.

For example, performing at least the nonlinear adjustment on the amplitude of the differential beam forming signal based on the distance between the two microphones and the signal frequency of the input signal to obtain the adjusted differential beam forming signal, includes: performing the nonlinear adjustment on the amplitude of the differential beam forming signal and an adjustment on a phase of the differential beam forming signal respectively based on the distance between the two microphones and the signal frequency of the input signal to obtain the adjusted differential beam forming signal. This embodiment provides a specific implementation mode of performing at least the nonlinear adjustment on the amplitude of the differential beam forming signal based on the distance between the two microphones and the signal frequency of the input signal to obtain the adjusted differential beam forming signal.

For example, performing the nonlinear adjustment on the amplitude of the differential beam forming signal and the adjustment on the phase of the differential beam forming signal respectively based on the distance between the two microphones and the signal frequency of the input signal to obtain the adjusted differential beam forming signal, includes: performing the nonlinear adjustment on the amplitude of the differential beam forming signal and a linear adjustment on the phase of the differential beam forming signal respectively based on the distance between the two microphones and the signal frequency of the input signal to obtain the adjusted differential beam forming signal. This embodiment provides a specific implementation mode of performing the nonlinear adjustment on the amplitude of the differential beam forming signal and the adjustment on the phase of the differential beam forming signal respectively based on the distance between the two microphones and the signal frequency of the input signal to obtain the adjusted differential beam forming signal.

For example, performing the nonlinear adjustment on the amplitude of the differential beam forming signal and the linear adjustment on the phase of the differential beam forming signal respectively based on the distance between the two microphones and the signal frequency of the input signal to obtain the adjusted differential beam forming signal, includes: adjusting the differential beam forming signal based on a preset compensation filter to obtain the adjusted differential beam forming signal, a system function of the compensation filter being $$[HL(\omega)]^{-1} = 2je^{-j\frac{\omega\tau}{2}}[\sin(\omega\tau)],$$

where $\tau=d/c$, d is the distance between the two microphones, c is a sound propagation speed in the air, and $\omega$ is a signal angular frequency of the input signal. This embodiment provides a specific implementation mode of performing the nonlinear adjustment on the amplitude of the differential beam forming signal and the linear adjustment on the phase of the differential beam forming signal respectively based on the distance between the two microphones and the signal frequency of the input signal to obtain the adjusted differential beam forming signal.

For example, obtaining the differential beam forming signal according to the input signal acquired by the two microphones in the microphone array, includes: determining a sound source position according to the input signal; determining a beam forming mode according to the sound source position; and processing the input signal according to the determined beam forming mode and outputting the differential beam forming signal. This embodiment provides a specific implementation mode of obtaining the differential beam forming signal according to the input signal acquired by the two microphones in the microphone array.

For example, determining the beam forming mode according to the sound source position includes: determining that the beam forming mode is a fixed differential beam forming mode if the sound source position belongs to a preset target sound source range; and determining that the beam forming mode is an adaptive differential beam forming mode if the sound source position belongs to a preset interference range. This embodiment provides a specific implementation mode of determining the beam forming mode according to the sound source position.

For example, the method for forming a differential beam is applied to the apparatus for forming a differential beam. The apparatus for forming a differential beam at least includes a forward differential filter for receiving the input signal, a backward differential filter for receiving the input signal, an adaptive filter connected to the backward differential filter, an adder connected to the forward differential filter and connected to the adaptive filter respectively, and a compensation filter connected to the adder. In the fixed differential beam forming mode, a coefficient of the adaptive filter is a fixed value. In the adaptive method for forming a differential beam, the coefficient of the adaptive filter is adaptively changed.

For example, when the beam forming mode is the fixed differential beam forming mode, the output differential beam forming signal is an 8-shaped beam. In a heart-shaped beam adopted in the existing technology, a beam distortion is easy to occur for the microphone array of larger specifications, so that the amplitude of the beam in the target sound source direction is smaller than the amplitude of the beam in the non-target sound source direction. In this embodiment, the 8-shaped beam is adopted, which has a narrow beam width and can improve the problem that the amplitude of the differential beam forming signal in the target sound source direction is smaller than the amplitude of the differential beam forming signal in the non-target sound source direction.

For example, the two microphones are a first microphone and a second microphone respectively, and a distance between the first microphone and the target sound source is smaller than a distance between the second microphone and the target sound source. A perpendicular bisector of a connecting line of the two microphones divides the two microphones into two different half-planes, the target sound source range is a half-plane where the first microphone is located, and the interference range is a half-plane where the second microphone is located. This embodiment provides a specific implementation mode of dividing the target sound source range and the interference range.

For example, the distance between the two microphones is greater than or equal to 2.5 cm. In this embodiment, compared with the existing method for forming a differential beam, the method for forming a differential beam in the present disclosure can still maintain the constant beam characteristics of the differential beam forming signal for the microphone array in which the distance between the two microphones is greater than or equal to 2.5.

BRIEF DESCRIPTION OF THE DRAWINGS

One or more embodiments are described as examples with reference to the corresponding figures in the accompanying drawings, and the examples do not constitute a limitation on the embodiments. Elements with the same reference numerals in the accompanying drawings represent similar elements. The figures in the accompanying drawings do not constitute a proportion limitation unless otherwise stated.

DETAILED DESCRIPTION

In order to make objectives, technical solutions and advantages of the present disclosure clearer, some embodiments of the present disclosure will be explained below in detail with reference to accompanying drawings and embodiments. It should be understood that specific embodiments described herein only explain the disclosure but do not constitute a limitation on the disclosure.

A first embodiment of the present disclosure relates to a method for forming a differential beam, which is applied to an electronic device including a microphone array. The electronic device may be a head-mounted device, an earphone, or a hearing aid, and the like. The microphone array includes one or more sets of microphones, and each set of microphones includes two microphones. In this embodiment and subsequent embodiments, a microphone array including one set of microphones is taken as an example for description. For a microphone array including multiple sets of microphones, one set of microphones may be turned on as desired during use, which is also applicable to the method for forming a differential beam in the present disclosure. In addition, it should be noted that the microphone arrays which the method for forming a differential beam is applied to according to various embodiments of the present disclosure are all microphone arrays suitable for noise suppression in a differential manner, that is, generally speaking, a distance between the two microphones is less than or equal to 6 cm.

Taking the earphone as the electronic device as an example, the microphone array in the earphone is in a normal use position when a user wears the earphone, and the user's mouth is a target sound source. One of the two microphones faces to the user's mouth to receive a signal in a direction of the user's mouth, while the other microphone faces away from the user's mouth, which is mainly used to receive a signal in an opposite direction of the user's mouth.

Figure 1:
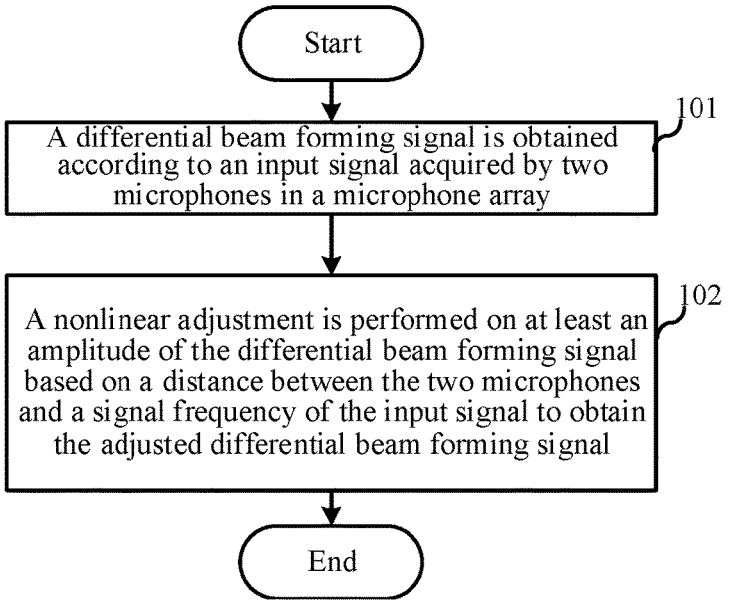
FIG. 1 is a specific flow chart of a method for forming a differential beam according to a first embodiment of the present disclosure.

A specific flow of the method for forming a differential beam in this embodiment is shown in FIG. 1.

In step 101, a differential beam forming signal is obtained according to an input signal acquired by two microphones in a microphone array.

Specifically, a first microphone and a second microphone respectively acquire an input signal of a target sound source and respectively input the input signal into an apparatus for forming a differential beam which the method for forming a differential beam is applied to according to the present disclosure, so as to obtain the differential beam forming signal.

It should be noted that, in this embodiment, after the two microphones collect the input signals of the target sound source, a Fourier transform is performed on the input signals collected by the two microphones. The input signal of each microphone is transformed from a time domain signal to a frequency domain signal, which is taken as the signal input into the apparatus for forming a differential beam.

In step 102, a nonlinear adjustment is performed on at least an amplitude of the differential beam forming signal based on a distance between the two microphones and a signal frequency of the input signal to obtain the adjusted differential beam forming signal.

Specifically, adjusting the differential beam forming signal includes adjusting both an amplitude and a phase of the differential beam forming signal. When the amplitude of the differential beam forming signal is adjusted, at least the amplitude of the differential beam forming signal is adjusted nonlinearly based on the distance between the two microphones and the signal frequency of the input signal. When the phase of the differential beam forming signal is adjusted, the phase of the differential beam forming signal is adjusted based on the distance between the two microphones and the signal frequency of the input signal. In an example, the phase of the differential beam forming signal may be linearly adjusted based on the distance between the two microphones and the signal frequency of the input signal. After the amplitude and the phase of the differential beam forming signal is adjusted, the adjusted differential beam forming signal is obtained.

In an example, when the amplitude and the phase of the differential beam forming signal is adjusted, the differential beam forming signal is adjusted based on a preset compensation filter to obtain the adjusted differential beam forming signal. A system function of the compensation filter is $$[HL(\omega)]^{-1} = 2je^{-j\frac{\omega\tau}{2}}[\sin(\omega\tau)],$$

where $\tau = d/c$, d is the distance between the two microphones, c is a sound propagation speed in the air, and $\omega$ is a signal angular frequency of the input signal, which is proportional to the frequency and is $2\pi$times of the frequency.

In an example, the distance between the two microphones in the microphone array is greater than or equal to 2.5 cm. Compared with the existing method for forming a differential beam, the method for forming a differential beam in the present disclosure may still maintain the constant beam characteristics of the differential beam forming signal.

Figure 2:
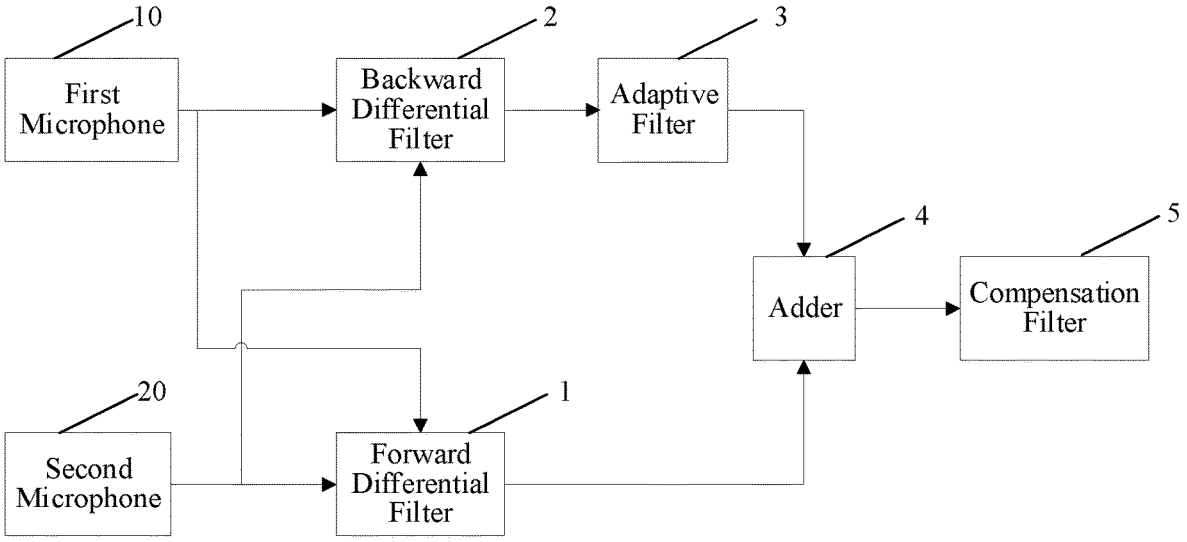
FIG. 2 is a schematic diagram of an apparatus for forming a differential beam which the method for forming a differential beam is applied to according to the first, a fourth, a fifth embodiment of the present disclosure.

The apparatus for forming a differential beam which the method for forming a differential beam applied to according to this embodiment is described as an example. The apparatus for forming a differential beam may be a apparatus of a chip in an electronic device. Referring to FIG. 2, the apparatus for forming a differential beam includes a forward differential filter 1 including a delayer and an adder, a backward differential filter 2 including a delayer and an adder, an adaptive filter 3, an adder 4 and a compensation filter 5. Herein, a first microphone 10 and a second microphone 20 are two microphones in the microphone array of the electronic device, and a distance between the first microphone 10 and the target sound source is smaller than a distance between the second microphone 20 and the target sound source when the electronic device is in a normal use state, that is, when the microphone array is in a normal use position, which is taken as an example for description.

In this embodiment, an amplitude expression of the target sound source is denoted as S(ω), a direction vector of the target sound source is $$a(\omega,\theta)=\left[e^{j\frac{\omega\tau}{2}\cos\theta},\ e^{-j\frac{\omega\tau}{2}\cos\theta}\right]^T,$$

and a system function of the forward differential filter 1 is $Hf(\omega)=[1,\ -e^{-j\omega\tau}]^T$, a system function of the backward differential filter 2 is $Hb(\omega)=[-e^{j\omega\tau},1]^T$, and the system function of the compensation filter is $$[HL(\omega)]^{-1}=2je^{-j\frac{\omega\tau}{2}}[\sin(\omega\tau)],$$

where θ is an angle of the target sound source deviating from the direction facing to the first microphone 10, and τ=d/c, where d is the distance between the two microphones, c is the sound propagation speed in the air, and ω is the signal angular frequency of the input signal.

In step 101, the first microphone 10 and the second microphone 20 acquires the input signals of the target sound source, and then respectively input the input signals to the apparatus for forming a differential beam. The signal obtained after passing through the forward differential filter 1, that is, the signal output by the forward differential filter 1 is $$C_F(\omega,\theta)=S(\omega)\cdot a(\omega,\theta)\cdot Hf(\omega)=S(\omega)\left[e^{j\frac{\omega\tau}{2}\cos\theta}-e^{-j\frac{\omega\tau}{2}\cos\theta}e^{-j\omega\tau}\right]=$$
$$S(\omega)e^{-j\frac{\omega\tau}{2}}\left[e^{j\frac{\omega\tau}{2}(1+\cos\theta)}-e^{-j\frac{\omega\tau}{2}(1+\cos\theta)}\right]=2jS(\omega)e^{-j\frac{\omega\tau}{2}}\sin\left(\frac{\omega\tau}{2}(1+\cos\theta)\right)$$

The signal obtained after passing through the backward differential filter 2, that is, the signal output by the backward differential filter 2 is $$C_B(\omega,\theta)=S(\omega)\cdot a(\omega,\theta)\cdot Hb(\omega)=S(\omega)\left[e^{-j\frac{\omega\tau}{2}\cos\theta}-e^{j\frac{\omega\tau}{2}\cos\theta}e^{-j\omega\tau}\right]=$$
$$S(\omega)e^{-j\frac{\omega\tau}{2}}\left[e^{j\frac{\omega\tau}{2}(1-\cos\theta)}-e^{-j\frac{\omega\tau}{2}(1-\cos\theta)}\right]=2jS(\omega)e^{-j\frac{\omega\tau}{2}}\sin\left(\frac{\omega\tau}{2}(1-\cos\theta)\right)$$

The signal $C_B(\omega,\theta)$ output by the backward differential filter 2 is input to the adaptive filter 3, and β represents a coefficient of the adaptive filter 3, so that the signal output by the adaptive filter 3 may be obtained as $\beta C_B(\omega,\theta)$.

Then, the signal $\beta C_B(\omega,\theta)$ output by the adaptive filter 3 and the signal $C_F(\omega,\theta)$ output by the forward differential filter 1 are respectively input to the adder 4, and the signal $\beta C_B(\omega,\theta)$ output by the adaptive filter 3 is subtracted from the signal $C_F(\omega,\theta)$ output by the forward differential filter 1 as an output of the adder 4, that is, the differential beam forming signal $$Y(\omega,\theta)=C_F(\omega,\theta)-\beta C_B(\omega,\theta)=$$
$$2jS(\omega)e^{-j\frac{\omega\tau}{2}}\left[\sin\left(\frac{\omega\tau}{2}(1+\cos\theta)\right)-\beta\sin\left(\frac{\omega\tau}{2}(1-\cos\theta)\right)\right]$$

In step 102, the differential beam forming signal Y(ω,θ) is input to the compensation filter 5 to obtain the adjusted differential beam forming signal $$Y'(\omega,\theta)=Y(\omega,\theta)\cdot HL(\omega)=$$
$$2jS(\omega)e^{-j\frac{\omega\tau}{2}}\left[\sin\left(\frac{\omega\tau}{2}(1+\cos\theta)\right)-\beta\sin\left(\frac{\omega\tau}{2}(1-\cos\theta)\right)\right]\cdot HL(\omega)$$

After the differential beam forming signal Y(ω,θ) is input to the compensation filter 5, it is necessary to make the adjusted differential beam forming signal Y' (ω,θ) better restore the signal in a target sound source direction. In this embodiment, the user's mouth is the target sound source. The first microphone 10 faces to the user's mouth to receive the signal in a direction of the user's mouth, which may be regarded as facing to the direction of the user's mouth, that is, θ=0 is the target sound source direction. Therefore, in order to better restore the signal in the target sound source direction, when θ=0, Y' (ω,θ)=S(ω) needs to be satisfied. Thus, the system function of the compensation filter 5 may be derived as $$[HL(\omega)]^{-1}=2je^{-j\frac{\omega\tau}{2}}[\sin(\omega\tau)].$$

Figure 3:
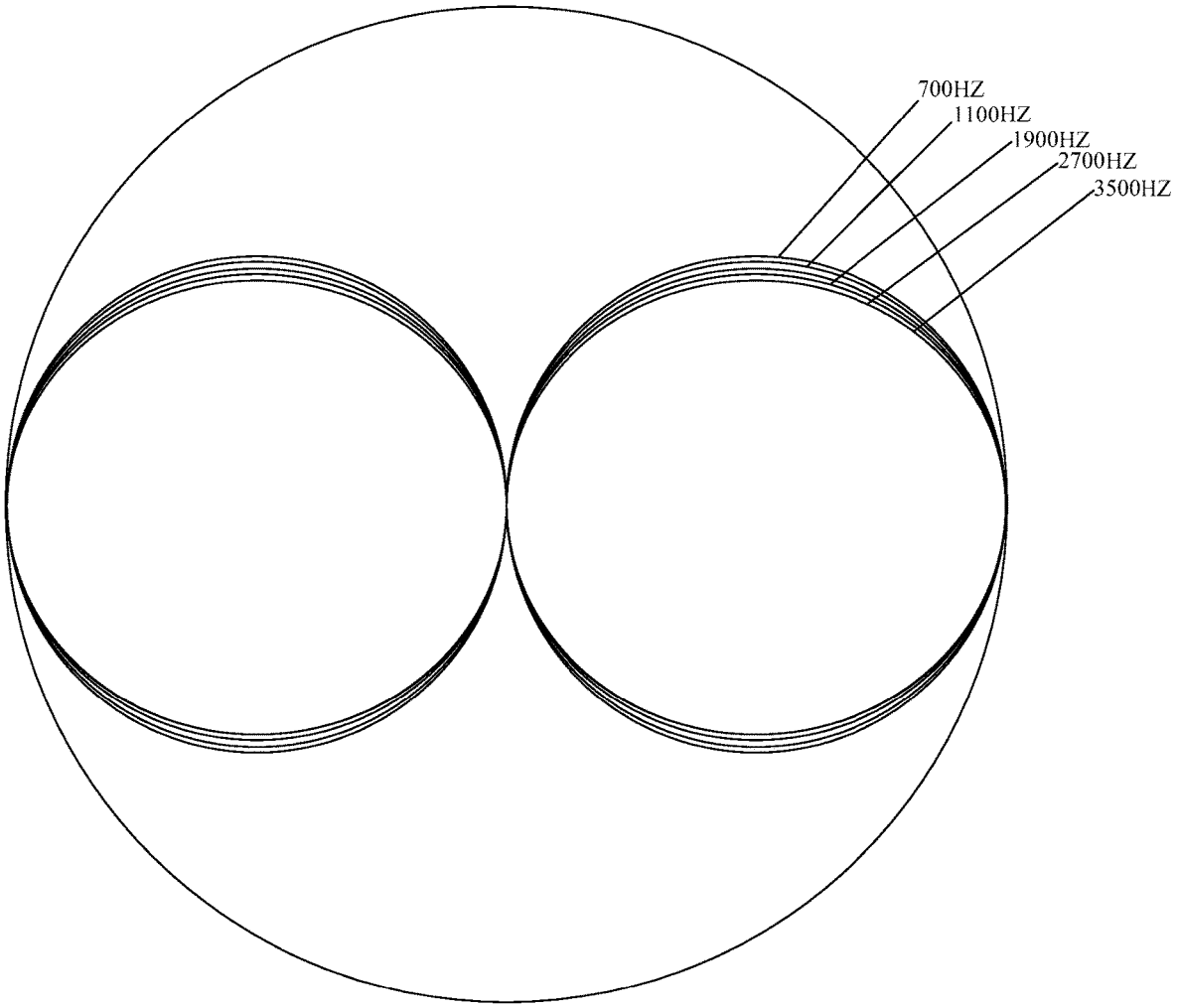
FIG. 3 is a beam diagram of a differential beam forming signal according to the first embodiment of the present disclosure.

As shown in FIG. 3, which is a beam diagram of the adjusted differential beam forming signal, it can be seen that an amplitude difference of beams with different frequencies is small and has the constant beam characteristics.

Compared with existing technologies, the input signal is acquired by the two microphones of the microphone array in this embodiment, and then the differential beam forming signal is obtained according to the input signal acquired by the two microphones, and then at least the amplitude of the differential beam forming signal is nonlinearly adjusted based on the distance between the two microphones and the signal frequency of the input signals to obtain the adjusted differential beam forming signal. In other words, this embodiment provides an adjustment method. For microphone arrays of different specifications, the constant beam characteristic of the differential beam forming signal can be ensured as much as possible after at least the amplitude of the differential beam forming signal is nonlinearly adjusted based on the distance between the two microphones and the signal frequency of the input signal.

A second embodiment of the present disclosure relates to a method for forming a differential beam. This embodiment is a refinement on the basis of the first embodiment. The main refinement lies in that it provides a specific implementation mode to obtain the differential beam forming signal according to the input signal obtained by the two microphones in the microphone array.

Figure 4:
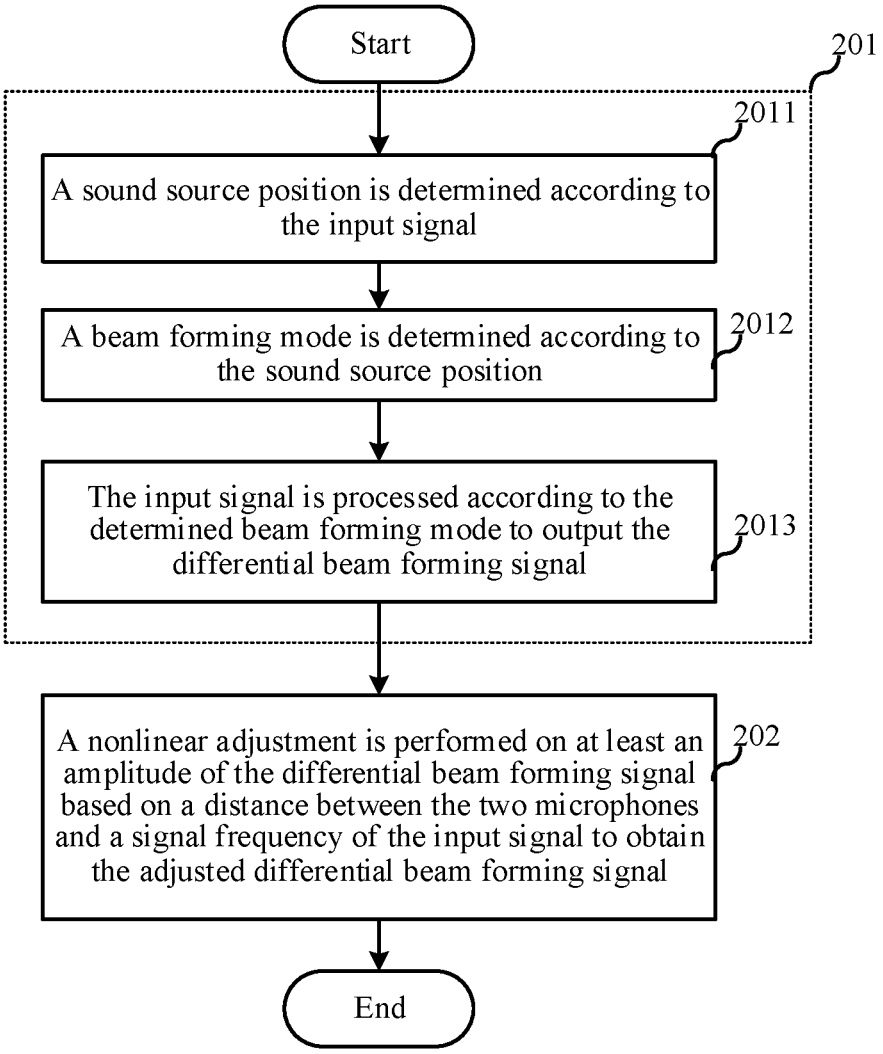
FIG. 4 is a specific flow chart of a method for forming a differential beam according to a second embodiment of the present disclosure.

The specific flow of the method for forming a differential beam in this embodiment is shown in FIG. 4.

Step 201 includes the following sub-steps:

In sub-step 2011, a sound source position is determined according to the input signal.

Specifically, according to the differential beam forming signal $$Y(\omega,\theta)=2jS(\omega)e^{-j\frac{\omega\tau}{2}}\left[\sin\left(\frac{\omega\tau}{2}(1+\cos\theta)\right)-\beta\sin\left(\frac{\omega\tau}{2}(1-\cos\theta)\right)\right]$$

calculated in the first embodiment, the differential beam forming signal is 0 at a null position of the differential beam forming signal, and $\theta_{null}$ represents an angle deviating from the direction facing to a first microphone 11 at the null position, that is, when $\theta=\theta_{null}$, $Y(\omega,\theta_{null})=0$, it can be concluded that:

$$\sin\left(\frac{\omega\tau}{2}(\cos\theta_{null}+1)\right)-\beta\sin\left(\frac{\omega\tau}{2}(\cos\theta_{null}-1)\right)=0$$

The equation is solved to obtain $$\beta=\frac{\sin\left(\frac{\omega\tau}{2}(1+\cos\theta_{null})\right)}{\sin\left(\frac{\omega\tau}{2}(1-\cos\theta_{null})\right)}.$$

It can be seen that β changes with $\theta_{null}$, so $\theta_{null}$ may also be controlled by controlling β, that is, the null position of the differential beam forming signal may be controlled by controlling β. In this way, the beam diagram of the differential beam forming signal may be controlled. In solving β, it is necessary to minimize the differential beam forming signal $Y(\omega,\theta)$ in a mean square sense, that is, $$\begin{cases}\min|Y(\omega,\theta)|^2 & \theta\neq 0\\ |Y(\omega,\theta)|^2=1 & \theta=0\end{cases}$$

$$\min|Y(\omega,\theta)|^2=\min[c_F(t)-\beta c_B(t)]^2=R_{c_Bc_B}(0)\beta^2-2\beta R_{c_Fc_B}(0)+R_{c_Fc_B}(0)$$

A wiener solution $$\beta=\frac{R_{c_Fc_B}(0)}{R_{c_Bc_B}(0)}$$

is obtained, where $R_{C_BC_B}(0)$ represents a autocorrelation value of the signal $C_B(\omega,\theta)$ output by the backward differential filter 2, $R_{C_FC_B}(0)$ represents a cross-correlation value between the signal $C_F(\omega,\theta)$ output by the forward differential filter 1 and the signal $C_B(\omega,\theta)$ output by the backward differential filter 2.

It can be seen from the above that the value of β may be obtained from the signal $C_F(\omega,\theta)$ output by the forward differential filter 4 and the signal $C_B(\omega,\theta)$ output by the backward differential filter 2, so that $C_F(\omega,\theta)$ and $C_B(\omega,\theta)$ may be calculated from the input signals of the two microphones, and then the value of β may be obtained.

Then the sound source position may be determined according to the value of β.

Figure 5:
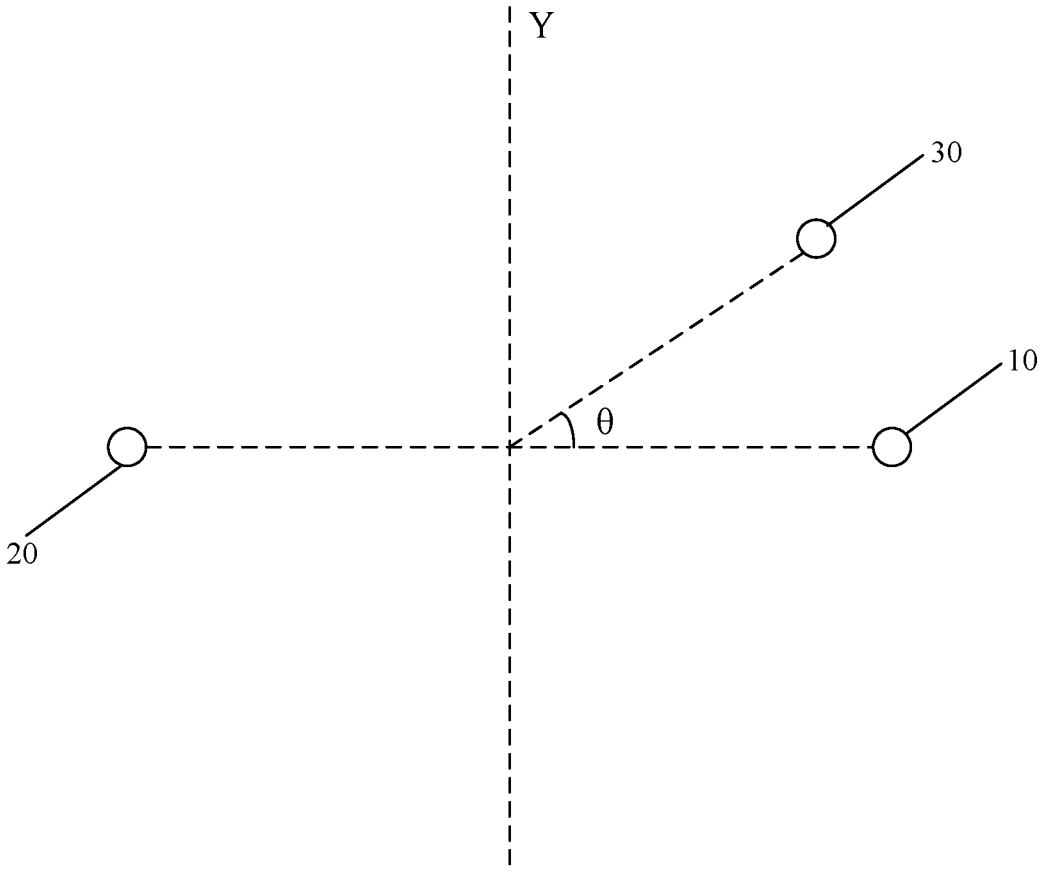
FIG. 5 is a schematic plan view of a formation of two microphones and a target sound source according to the second embodiment of the present disclosure.

In an example, referring to FIG. 5, the first microphone 10, the second microphone 20 and a target sound source 30 form a plane. A perpendicular bisector Y of a connecting line between the first microphone 10 and the second microphone 20 divides the two microphones into two different half planes of the plane, that is, the plane is divided into two half planes: $0\leq\theta<90$ is a front half plane, and $90\leq\theta\leq180$ is a rear half plane. The first microphone is located in the front half plane, and $\theta=0$ is the target sound source direction. When $0<\theta<90$, it is considered that the target sound source deviates from the first microphone 10 to a small extent, and it may still be considered as the target sound source direction. The second microphone is located in the rear half plane, and when $90\leq\theta\leq180$, it is considered that the target sound source deviates from the first microphone 10 to a large extent, so it is considered as a non-sound source direction. When the microphone array is in the normal use position, the first microphone 10 is closer to the target sound source 30 than the second microphone 20. A target sound source range is the half plane where the first microphone 10 is located, that is, the target sound source range is the front half plane, $0\leq\theta<90$, and an interference range is the half plane where the second microphone 20 is located, that is, the interference sound source range is the rear half plane, $90\leq\theta\leq180$.

When $|\beta|>1$, it is determined that the sound source position belongs to a preset target sound source range. When $|\beta|<1$, it is determined that the sound source position belongs to a preset interference range.

In sub-step 2012, a beam forming mode is determined according to the sound source position.

Figure 6:
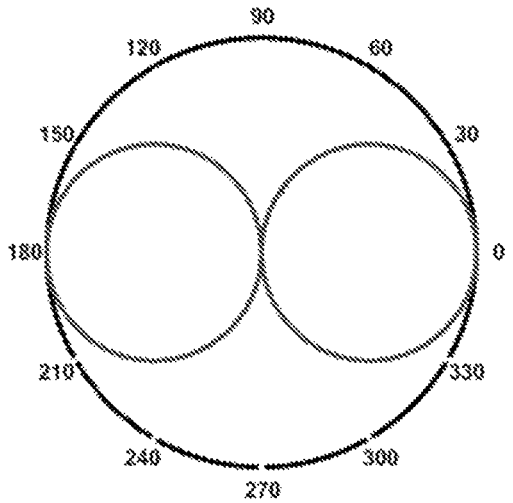
FIG. 6 is a schematic diagram of an 8-shaped beam according to the second embodiment of the present disclosure.

Specifically, when $|\beta|>1$, the sound source position belongs to the target sound source range, and the input signal comes from the front half plane. At this time, it is considered that the received signal contains the signal of the target sound source and may not be nulled, so a fixed differential beam forming mode is adopted as the beam forming mode. At this time, the output differential beam forming signal is an 8-shaped beam. As shown in FIG. 6, which is an 8-shaped beam pattern, it can be seen that the null position of the 8-shaped beam is 90°. According to the formula $$\beta=\frac{\sin\left(\frac{\omega\tau}{2}(1+\cos\theta_{null})\right)}{\sin\left(\frac{\omega\tau}{2}(1-\cos\theta_{null})\right)},$$

it may be obtained that $\beta=1$ in the 8-shaped beam. Therefore, in this embodiment, when $\beta>1$, set $\beta=1$, and when $\beta<-1$, set $\beta=-1$, that is, set an absolute value of a coefficient β of the adaptive filter 5 to be 1, so that the formed differential beam forming signal is the 8-shaped beam. In a heart-shaped beam adopted in the existing technologies, a beam distortion is easy to occur for the microphone array with larger specifications, so that the amplitude of the beam in the target sound source direction is smaller than that in the amplitude of the non-target sound source direction. In the present disclosure the 8-shaped beam is adopted, which has a narrow beam width and may improve the problem that the amplitude of the differential beam forming signal in the target sound source direction is smaller than that in the non-target sound source direction. Herein, in the fixed differential beam forming mode, the coefficient of the adaptive filter 5 is a fixed value. That is, the fixed differential beam forming mode may be understood as that the input signals of the two microphones are respectively differentiated by the forward differential filter 1 and the backward differential filter 2, and the signal differentiated by the backward differential filter 2 is input to the adaptive filter 3 with a fixed coefficient. After the signal output by the adaptive filter 3 and the signal output by the forward differential filter 1 are input to the adder 4, the adder 4 outputs the differential beam forming signal.

When $|\beta|<1$, the sound source position belongs to the preset interference range, and the input signal comes from the rear half plane. At this time, the received signal is considered as an interference signal and needs to be nulled. The beam forming mode is determined as an adaptive differential beam forming mode, and the calculated value of β is taken as the coefficient of the adaptive filter 5, so that the interference signal may be suppressed by adaptive nulling. Herein, in the adaptive differential beam forming mode, the coefficient of the adaptive filter 5 is adaptively changed. That is to say, the adaptive differential beam forming mode may be understood as that the input signals of the two microphones are differentiated by the forward differential filter 1 and the backward differential filter 2 respectively. The signals differentiated by the backward differential filter 2 are input to the adaptive filter 3 with an adaptively changed coefficient. After the signal output by the adaptive filter 3 and the signal output by the forward differential filter 1 are input to the adder 4, the adder 4 outputs the differential beam forming signal.

In sub-step 2013, the input signal is processed according to the determined beam forming mode, and the differential beam forming signal is output.

Specifically, the input signals acquired by the first microphone 10 and the second microphone 20 are processed according to the beam forming mode determined in the sub-step 2012, and the corresponding differential beam forming signals are output.

In step 202, a nonlinear adjustment is performed on at least an amplitude of the differential beam forming signal based on a distance between the two microphones and a signal frequency of the input signal to obtain the adjusted differential beam forming signal.

Specifically, step 202 is substantially the same as step 102 in the first embodiment, and will not be repeated here.

Compared with the first embodiment, this embodiment provides a specific implementation mode of obtaining the differential beam forming signal according to the input signal acquired by the two microphones in the microphone array.

A third embodiment of the present disclosure relates to a method for processing a signal, which is applied to an electronic device including a microphone array. The electronic device may be a head-mounted device, an earphone, or a hearing aid, and the like. The microphone array includes one or more sets of microphones, and each set of microphones includes two microphones. In this embodiment and subsequent embodiments, a microphone array including one set of microphones is taken as an example for description. For a microphone array including multiple sets of microphones, one set of microphones may be turned on as desired during use, which is also applicable to the method for forming a differential beam in the present disclosure.

Figure 7:
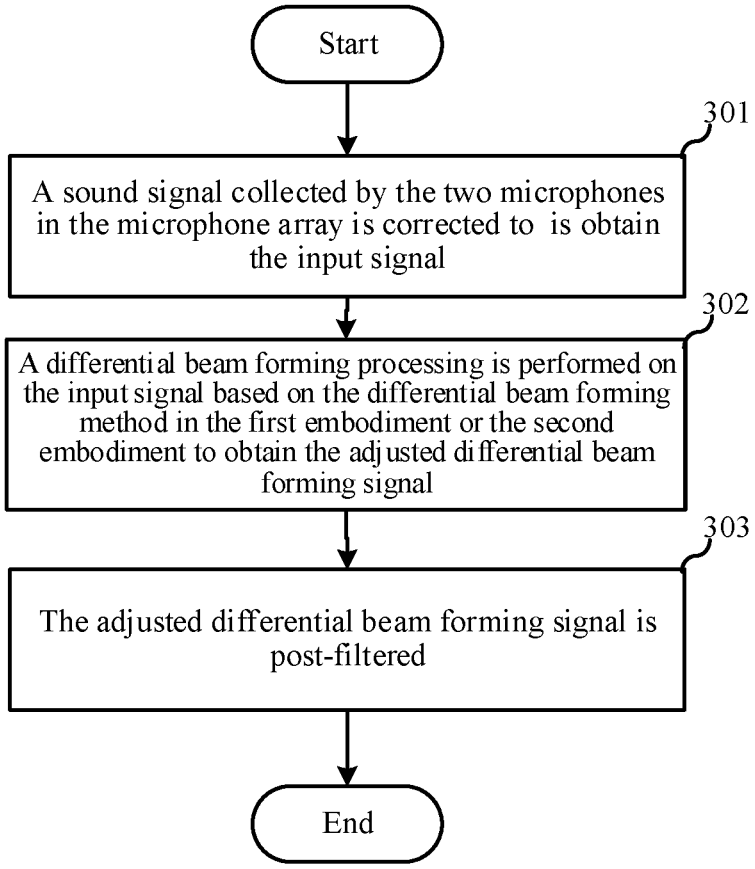
FIG. 7 is a specific flow chart of a method for processing a signal according to a third embodiment of the present disclosure.

The specific flow of the method for processing a signal in this embodiment is shown in FIG. 7.

In step 301, a sound signal collected by the two microphones in the microphone array is corrected to obtain the input signal.

Specifically, an amplitude and a phase of the sound signals collected by the two microphones are corrected to obtain the input signal, so that the input signal meets the use requirements of the method for forming a differential beam in the first embodiment or the second embodiment. For example, in this embodiment, the amplitude and the phase of one of the two sound signals collected by the two microphones is corrected, so that the corrected amplitude and the corrected phase of the sound signal is consistent with the amplitude and the phase of the other sound signal.

In step 302, a differential beam forming processing is performed on the input signal based on the method for forming a differential beam in the first embodiment or the second embodiment to obtain the adjusted differential beam forming signal.

Specifically, the method for forming a differential beam in the first embodiment or the second embodiment is used to perform the differential beam forming processing on the input signal obtained in step 301 to obtain the adjusted differential beam forming signal. Refer to the first embodiment and the second embodiment for specific processing, which will not be repeated here.

In step 303, the adjusted differential beam forming signal is post-filtered.

Specifically, the post-filtering is performed based on the difference of time domain between a desired signal and an interference signal, so that the residual interference signal in the adjusted differential beam forming signal may be suppressed more effectively. The post-filtering mode may be a Wiener post-filtering method, which may accurately estimate a spectral information of the desired signal or a spectral information of the interference signal, and then determine a filter coefficient of the Wiener post-filtering according to different optimization criteria, for example, a minimum mean square error criterion, and then perform the post-filtering on the adjusted differential beam forming signal to obtain the output signal.

Compared with existing technologies, this embodiment provides the method for processing a signal which the method for forming a differential beam is applied to according to the first embodiment or the second embodiment. The input signal is acquired by the two microphones of the microphone array, and then the differential beam forming signal is obtained according to the input signal acquired by the two microphones, and then at least the amplitude of the differential beam forming signal is nonlinearly adjusted based on the distance between the two microphones and the signal frequency of the input signals to obtain the adjusted differential beam forming signal. In other words, this embodiment provides an adjustment method. For microphone arrays of different specifications, the constant beam characteristic of the differential beam forming signal can be ensured as much as possible after at least the amplitude of the differential beam forming signal is nonlinearly adjusted based on the distance between the two microphones and the signal frequency of the input signal.

A fourth embodiment of the present disclosure relates to an apparatus for forming a differential beam, which is applied to an electronic device including a microphone array. The electronic device may be a head-mounted device, an earphone, or a hearing aid, and the like. The microphone array includes at least one set of microphones, and each set of microphones includes two microphones. This embodiment and subsequent embodiments take two microphones in each set of microphones in the microphone array as an example for description.

As shown in FIG. 2, the apparatus for forming a differential beam 100 includes:

a forward differential filter 1 and a backward differential filter 2, configured to receive an input signal acquired by two microphones in a microphone array;

an adaptive filter 3 connected to the backward differential filter 2;

an adder 4 connected to the forward differential filter 1 and the adaptive filter 3 respectively;

wherein the input signal is processed by the forward differential filter 1, the backward differential filter 2 and the adaptive filter 3 to output by the adder 4 to obtain the differential beam forming signal; and a compensation filter 5 connected to the adder 4, configured to perform a nonlinear adjustment on at least an amplitude of the differential beam forming signal based on a distance between the two microphones and a signal frequency of the input signal to obtain the adjusted differential beam forming signal.

Specifically, adjusting the differential beam forming signal includes adjustments on both the amplitude and a phase. When the amplitude of the differential beam forming signal is adjusted, at least the amplitude of the differential beam forming signal is adjusted nonlinearly based on the distance between the two microphones and the signal frequency of the input signal. When a phase of the differential beam forming signal is adjusted, the phase of the differential beam forming signal is adjusted based on the distance between the two microphones and the signal frequency of the input signal. In an example, the phase of the differential beam forming signal may be linearly adjusted based on the distance between the two microphones and the signal frequency of the input signal. The amplitude and the phase of the differential beam forming signal are adjusted to obtain the adjusted differential beam forming signal.

In an example, when adjusting the amplitude and the phase of the differential beam forming signal, the compensation filter 5 adjusts the differential beam forming signal based on a preset compensation filter to obtain the adjusted differential beam forming signal. A system function of the compensation filter 5 is $$[HL(\omega)]^{-1} = 2je^{-j\frac{\omega\tau}{2}}[\sin(\omega\tau)],$$

where $\tau=d/c$, d is the distance between the two microphones, c is a sound propagation speed in the air, and $\omega$ is a signal angular frequency of the input signal.

In an example, the distance between the two microphones in the microphone array is greater than or equal to 2.5 cm. The apparatus for forming a differential beam in the present disclosure may still maintain the constant beam characteristics of the differential beam forming signal.

Since the first embodiment corresponds to this embodiment, this embodiment may be implemented in cooperation with the first embodiment. The relevant technical details mentioned in the first embodiment are still valid in this embodiment, and the technical effects achieved in the first embodiment may also be achieved in this embodiment. To reduce duplication, details will not be repeated here. Correspondingly, the relevant technical details mentioned in this embodiment may also be applied to the first embodiment.

Compared with existing technologies, the input signal is acquired by the two microphones of the microphone array in this embodiment, and then the differential beam forming signal is obtained according to the input signal acquired by the two microphones, and then at least the amplitude of the differential beam forming signal is nonlinearly adjusted based on the distance between the two microphones to obtain the adjusted differential beam forming signal. In other words, this embodiment provides an adjustment method. For microphone arrays of different specifications, the constant beam characteristic of the differential beam forming signal can be ensured as much as possible after at least the amplitude of the differential beam forming signal is nonlinearly adjusted based on the distance between the two microphones.

A fifth embodiment of the present disclosure relates to an apparatus for forming a differential beam. This embodiment is a refinement on the basis of the fourth embodiment. Referring to FIG. 2, the main refinement is as follows.

In this embodiment, when the microphone array is in the normal use position, a distance between the first microphone 10 and a target sound source is smaller than a distance between the second microphone 20 and the target sound source. A perpendicular bisector of a connecting line of the two microphones divides the two microphones into two different half-planes. The target sound source range is a half-plane where the first microphone is located, and the interference range is a half-plane where the second microphone is located.

The adaptive filter 3 is configured to determine a sound source position according to the input signal, determine a beam forming mode according to the sound source position, process the input signal according to the determined beam forming mode to be output by the adder 4 to obtain the differential beam forming signal.

Herein, the adaptive filter 3 is configured to determine that the beam forming mode is a fixed differential beam forming mode when the sound source position belongs to a preset target sound source range and determine that the beam forming mode is an adaptive differential beam forming mode when the sound source position belongs to a preset interference range.

Referring to the structure of the apparatus for forming a differential beam in FIG. 2, the coefficient of the adaptive filter 5 in the fixed differential beam forming mode is a fixed value. That is, the fixed differential beam forming mode may be understood as that the input signals of the two microphones are respectively differentiated by the forward differential filter 1 and the backward differential filter 2, and the signal differentiated by the backward differential filter 2 is input to the adaptive filter 3 with a fixed coefficient. After the signal output by the adaptive filter 3 and the signal output by the forward differential filter 1 are input to the adder 4, the adder 4 outputs the differential beam forming signal.

In the adaptive differential beam forming mode, the coefficient of the adaptive filter 5 is adaptively changed. That is to say, the adaptive differential beam forming mode may be understood as that the input signals of the two microphones are differentiated by the forward differential filter 1 and the backward differential filter 2 respectively. The signals differentiated by the backward differential filter 2 are input to the adaptive filter 3 with an adaptively changed coefficient. After the signal output by the adaptive filter 3 and the signal output by the forward differential filter 1 are input to the adder 4, the adder 4 outputs the differential beam forming signal.

In an example, when the beam forming mode is the fixed differential beam forming mode, the output differential beam forming signal is an 8-shaped beam, which has a narrow beam width and may improve the problem that the amplitude of the differential beam forming signal facing to the sound source position is smaller than the amplitude of the differential beam forming signal diagonally facing to the sound source position.

Since the second embodiment corresponds to this embodiment, this embodiment may be implemented in cooperation with the second embodiment. The relevant technical details mentioned in the second embodiment are still valid in this embodiment, and the technical effects achieved in the second embodiment may also be achieved in this embodiment. To reduce duplication, details will not be repeated here. Correspondingly, the relevant technical details mentioned in this embodiment may also be applied to the second embodiment.

Compared with the fourth embodiment, this embodiment provides a specific implementation mode of obtaining the differential beam forming signal according to the input signal acquired by the two microphones in the microphone array.

A sixth embodiment of the present disclosure relates to an apparatus for processing a signal, which is applied to an electronic device including a microphone array. The electronic device may be a head-mounted device, an earphone or a hearing aid, and the like. The microphone array includes at least one set of microphones, and each set of the microphones includes two microphones. In this embodiment and subsequent embodiments, the two microphones in one set of microphones in the microphone array are taken as an example for description.

Figure 8:
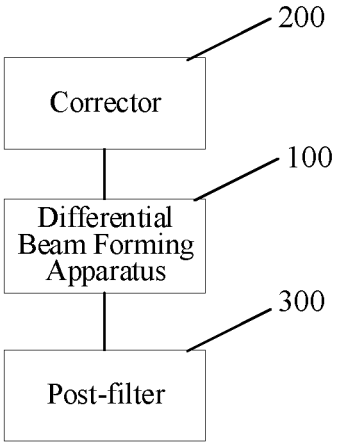
FIG. 8 is a schematic diagram of an apparatus for processing a signal according to a sixth embodiment of the present disclosure.

As shown in FIG. 8, the apparatus for processing a signal includes:

a corrector 200, configured to correct a sound signal collected by the two microphones in the microphone array to obtain the input signal;

the apparatus 100 for forming a differential beam in the fourth embodiment or the fifth embodiment, configured to perform a differential beam forming processing on the input signal to obtain the adjusted differential beam forming signal; and a post-filter 300, configured to post-filter the adjusted differential beam forming signal to obtain the output signal.

Since the third embodiment corresponds to this embodiment, this embodiment may be implemented in cooperation with the third embodiment. The relevant technical details mentioned in the third embodiment are still valid in this embodiment, and the technical effects achieved in the third embodiment may also be achieved in this embodiment. To reduce duplication, details will not be repeated here. Correspondingly, the relevant technical details mentioned in this embodiment may also be applied to the third embodiment.

Compared with existing technologies, this embodiment provides the apparatus for processing a signal including the apparatus for forming a differential beam in the fourth embodiment or the fifth embodiment. The input signal is acquired by the two microphones of the microphone array, and then the differential beam forming signal is obtained according to the input signal acquired by the two microphones, and then at least the amplitude of the differential beam forming signal is nonlinearly adjusted based on the distance between the two microphones to obtain the adjusted differential beam forming signal. In other words, this embodiment provides an adjustment method. For microphone arrays of different specifications, the constant beam characteristic of the differential beam forming signal can be ensured as much as possible after at least the amplitude of the differential beam forming signal is nonlinearly adjusted based on the distance between the two microphones.

A seventh embodiment of the present disclosure relates to a chip, including the apparatus for processing a signal of the sixth embodiment.

An eighth embodiment of the present disclosure relates to an electronic device, including a microphone array and the chip in the seventh embodiment. The microphone array includes at least two microphones, and the chip is connected to each microphone.

Those skilled in the art should appreciate that the above mentioned embodiments are specific examples for implementing the present disclosure. In practice, however, many changes can be made in forms and details of the specific embodiments without departing from the spirit and the scope of the present disclosure.

What is claimed is:

1. A method for adjusting a differential beam forming signal, comprising:

obtaining the differential beam forming signal according to an input signal acquired by two microphones in a microphone array; and performing a nonlinear adjustment on an amplitude of the differential beam forming signal based on a distance between the two microphones and a signal frequency of the input signal, and performing a linear adjustment on the phase of the differential beam forming signal based on the distance between the two microphones and the signal frequency of the input signal, to obtain an adjusted differential beam forming signal.

2. The method according to claim 1, wherein obtaining the differential beam forming signal according to the input signal acquired by the two microphones in the microphone array, comprises:

determining a sound source position according to the input signal;

determining a beam forming mode according to the sound source position; and processing the input signal according to the determined beam forming mode and outputting the differential beam forming signal.

3. The method according to claim 2, wherein determining the beam forming mode according to the sound source position comprises:

determining that the beam forming mode is a fixed differential beam forming mode if the sound source position belongs to a preset target sound source range; and determining that the beam forming mode is an adaptive differential beam forming mode if the sound source position belongs to a preset interference range.

4. The method according to claim 3, applied to an apparatus for forming a differential beam, wherein the apparatus for forming a differential beam at least comprises a forward differential filter for receiving the input signal, a backward differential filter for receiving the input signal, an adaptive filter connected to the backward differential filter, an adder connected to the forward differential filter and the adaptive filter respectively, and a compensation filter connected to the adder;

wherein a coefficient of the adaptive filter is a fixed value in the fixed differential beam forming mode; and the coefficient of the adaptive filter is adaptively changed in the adaptive differential beam forming mode.

5. The method according to claim 3, wherein when the beam forming mode is the fixed differential beam forming mode, the output differential beam forming signal is an 8-shaped beam.

6. The method according to claim 3, wherein the two microphones are a first microphone and a second microphone respectively, a distance between the first microphone and the target sound source is smaller than a distance between the second microphone and the target sound source, and a perpendicular bisector of a connecting line of the two microphones divides the two microphones into two different half-planes, wherein the target sound source range is a half-plane where the first microphone is located, and the interference range is a half-plane where the second microphone is located.

7. The method according to claim 1, wherein the distance between the two microphones is greater than or equal to 2.5 cm.

8. A method for processing a signal, comprising:

correcting an amplitude and a phase of a sound signal collected by the two microphones in the microphone array to obtain the input signal;

performing a differential beam forming processing on the input signal based on the method for adjusting a differential beam forming signal according to claim 1, and obtaining the adjusted differential beam forming signal; and post-filtering the adjusted differential beam forming signal.

9. An apparatus for adjusting a differential beam forming signal, comprising:

a forward differential filter and a backward differential filter, configured to receive an input signal acquired by two microphones in a microphone array;

an adaptive filter connected to the backward differential filter;

an adder connected to the forward differential filter and the adaptive filter respectively;

wherein the input signal is processed by the forward differential filter, the backward differential filter and the adaptive filter to be output by the adder to obtain the differential beam forming signal; and a compensation filter connected to the adder, configured to perform a nonlinear adjustment on at least an amplitude of the differential beam forming signal based on a distance between the two microphones and a signal frequency of the input signal to obtain the adjusted differential beam forming signal.

10. The apparatus according to claim 9, wherein the compensation filter is configured to perform the nonlinear adjustment on the amplitude of the differential beam forming signal and an adjustment on a phase of the differential beam forming signal respectively based on the distance between the two microphones and the signal frequency of the input signal to obtain the adjusted differential beam forming signal.

11. The apparatus according to claim 10, wherein the compensation filter is configured to perform the nonlinear adjustment on the amplitude of the differential beam forming signal and a linear adjustment on the phase of the differential beam forming signal respectively based on the distance between the two microphones and the signal frequency of the input signal to obtain the adjusted differential beam forming signal.

12. The apparatus according to claim 9, wherein the adaptive filter is configured to:

determine a sound source position according to the input signal;

determine a beam forming mode according to the sound source position; and process the input signal according to the determined beam forming mode to be output by the adder to obtain the differential beam forming signal.

13. The apparatus according to claim 12, wherein the adaptive filter is configured to determine that the beam forming mode is a fixed differential beam forming mode if the sound source position belongs to a preset target sound source range; and determine that the beam forming mode is an adaptive differential beam forming mode if the sound source position belongs to a preset interference range.

14. The apparatus according to claim 13, wherein the two microphones are a first microphone and a second microphone respectively, a distance between the first microphone and the target sound source is smaller than a distance between the second microphone and the target sound source, and a perpendicular bisector of a connecting line of the two microphones divides the two microphones into two different half-planes;

the target sound source range is a half-plane where the first microphone is located, and the interference range is a half-plane where the second microphone is located.

15. The apparatus according to claim 9, wherein the distance between the two microphones is greater than or equal to 2.5 cm.

16. An apparatus for processing a signal, comprising:

a forward differential filter and a backward differential filter, configured to receive an input signal acquired by two microphones in the microphone array;

an adaptive filter connected to the backward differential filter;

an adder connected to the forward differential filter and the adaptive filter respectively;

wherein the input signal is processed by the forward differential filter, the backward differential filter and the adaptive filter to be output by the adder to obtain the differential beam forming signal; and a compensation filter connected to the adder, configured to perform a nonlinear adjustment on at least an amplitude of the differential beam forming signal based on a distance between the two microphones and a signal frequency of the input signal to obtain the adjusted differential beam forming signal; and a post-filter, configured to post-filter the adjusted differential beam forming signal.

17. A chip, comprising the apparatus for processing the signal according to claim 16.

18. An electronic device, comprising a microphone array and the chip according to claim 17, wherein the microphone array comprises at least two microphones, and the chip is connected to each of the at least two microphones.

* * * * *